US007070123B2

(12) United States Patent
Naedler

(10) Patent No.: US 7,070,123 B2
(45) Date of Patent: Jul. 4, 2006

(54) MIST EVAPORATING DEVICE AND METHOD

(76) Inventor: Mark Naedler, 9407 Walnut Brook Ct., Houston, TX (US) 77040

( * ) Notice: Subject to any disclaimer, the term of this patent is extended or adjusted under 35 U.S.C. 154(b) by 0 days.

(21) Appl. No.: 10/951,133

(22) Filed: Sep. 27, 2004

(65) Prior Publication Data

US 2005/0067504 A1 Mar. 31, 2005

Related U.S. Application Data

(60) Provisional application No. 60/507,336, filed on Sep. 30, 2003.

(51) Int. Cl.
*B05B 3/06* (2006.01)
*B05B 15/06* (2006.01)

(52) U.S. Cl. ..... 239/251; 239/255; 239/261; 239/281

(58) Field of Classification Search ..... 239/251, 239/255, 261, 281, 18, 19, 97, 209, 246, 239/253, 280, 280.5, 381, DIG. 1
See application file for complete search history.

(56) References Cited

U.S. PATENT DOCUMENTS 414,346 A 11/1889 Wainwright
911,717 A * 2/1909 Gibbs ..... 239/251
1,880,244 A * 10/1932 Dugas ..... 169/5
2,558,663 A * 6/1951 Olschewski ..... 239/261
2,560,662 A * 7/1951 Rieger ..... 239/73
2,622,928 A * 12/1952 Misch ..... 239/226
2,727,366 A * 12/1955 Hagen ..... 62/304
2,983,452 A * 5/1961 Lindbloom ..... 239/259
3,042,318 A * 7/1962 Chow et al. ..... 239/458
3,593,730 A * 7/1971 Burchett ..... 134/123
4,700,897 A 10/1987 Smith et al.
4,925,097 A 5/1990 Corrigan
5,027,455 A 7/1991 Commisso et al.
5,111,993 A 5/1992 Baker
5,390,852 A 2/1995 Schuenemann et al.
5,439,176 A 8/1995 Bussiere
5,785,204 A 7/1998 Thompson et al.
5,961,044 A 10/1999 Dalbec et al.
6,257,502 B1 7/2001 Hanish et al.

* cited by examiner

*Primary Examiner*—David A. Scherbel
*Assistant Examiner*—Darren Gorman
(74) *Attorney, Agent, or Firm*—Browning Bushman P.C.

(57) ABSTRACT

The water misting system includes a stationary member 3, 4 having a flow path therein for transmitting water, the rotary swivel 5 in fluid communication with the stationary member, and one or more conduits 6, 7 in communication with the stationary member and extending radially outward from the swivel. A misting nozzle 8, 9 is provided at an outer end of each respective conduit, and has a central nozzle axis angled with respect to a central axis of a respective conduit for discharging mist while producing a tangential thrust for rotating the one or more conduits and the misting nozzle about the stationary member. According to the method of the invention, angling of the central nozzle axis of each misting nozzle with respect to a central axis of the respective conduit produces the tangential thrust to rotate the conduits and thereby mist a large area.

19 Claims, 5 Drawing Sheets

MIST EVAPORATING DEVICE AND METHOD

RELATED CASE

The present application claims priority from U.S. Ser. No. 60/507,336 filed on Sep. 30, 2003.

FIELD OF THE INVENTION

The present invention relates to devices for misting water to provide improved comfort to people in the area of the misting device. More particularly, the invention relates to a misting device and method which is relatively simple and provides misting to a large area.

BACKGROUND OF THE INVENTION

Evaporation of water with the use of misting nozzles has become a popular method for cooling outdoor areas. An arid atmosphere rapidly evaporates water and this effectively lowers the temperature of the air. In more humid climates, the evaporation rate is not as rapid and a water mist can sometimes make the area uncomfortably damp.

Simple misting systems usually include many stationary nozzles held above the area where cooling is desired. Unless there is significant wind, this can create a showerhead effect. Areas directly beneath the nozzles become wet and areas between the nozzles might not realize any cooling. It is preferred to divide the total flow rate of the water needed for the area into as many small misting nozzles as possible to distribute mist evenly. Small nozzles are prone to clogging.

Previously designed misting systems have sought to improve evaporation by placing the misting nozzles in the path of an electrically driven fan. This method is very effective at lowering the air temperature, but is noisy and will not necessarily provide all individuals in an area with a consistent environment. Those in the path of the fan may receive excessive moisture and cooling, and those out of the path might not feel the effect. The presence of water from the misters can add danger to the use of electricity powering the fan. Often poolside patios are the location for misting systems, and the use of electric fans is undesirable. Fans are also noisy and can be an annoyance.

The disadvantages of the prior art are overcome by the present invention and an improved misting device and method are hereinafter disclosed.

SUMMARY OF THE INVENTION

The present invention simply and safely improves the evaporation rate from a misting nozzle, as well as improves the comfort of individuals in the area. In one embodiment, a rotary assembly is capable of passing pressurized fluid from its stationary center to a number of tubes attached to its rotating exterior. The tubes can transport the fluid radially outward to attached misting nozzles. The misting nozzles travel in a circumference substantial enough to carry the water around a large area, blending the mist with churning fresh new air as the tubes rotate. The rotary assembly could be power with an external source, but preferably utilizes the thrust energy from the pressurized fluid to propel the tubes. The present invention may include a floor stand and a tall telescoping pole to allow for vertical adjustment of the tubes over an area to add distance between the nozzles and the individuals to improve evaporation if necessary. A quick-disconnecting rotary assembly is provided for easy storage.

DESCRIPTION OF THE ILLUSTRATED EMBODIMENTS

Figure 1:
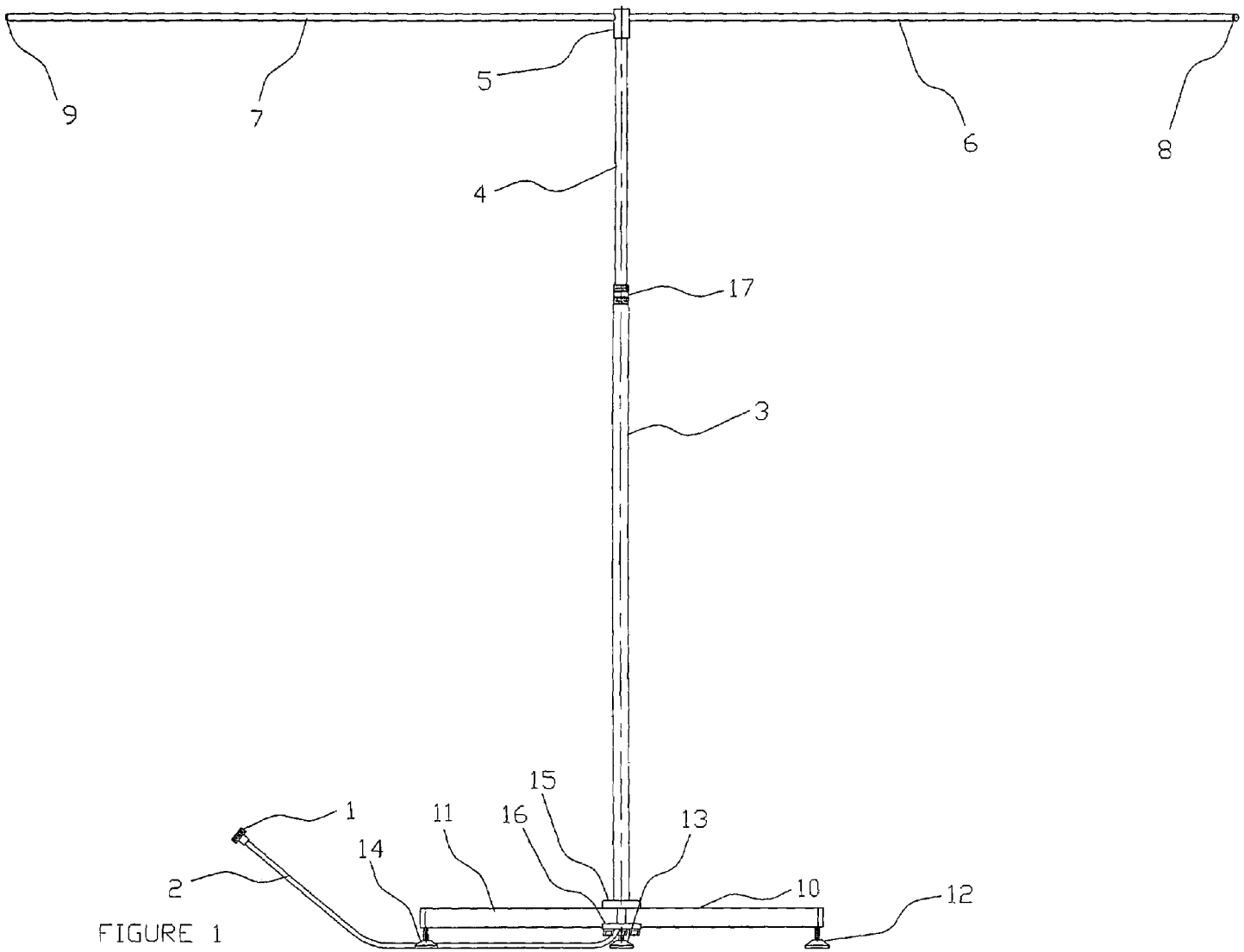
FIG. 1 illustrates a quickly detachable rotary assembly supported by a floor stand having a telescoping pole.

A preferred embodiment employs a principle found in many sprinkler and irrigation systems. These sprinkler system designs include thrust driven tubes rotating about a rotary connection to spray water over an area, but are not powered by misting nozzles intended for evaporating the water. Instead, these sprinkler systems rely on the trajectory of the water's stream to distribute water over the vast area the water irrigates. The rotating tubes primarily provide a means of changing the stream's direction to distribute the water evenly over a circular area and do not carry the water a significant distance from the sprinkler's axis. Evaporation is not desired from these watering devices.

A good misting nozzle deliberately disrupts the cohesiveness of the water's stream (absence of a cohesive stream) and aerates the water as much as possible. This destroys the water's trajectory and thrusting efficiency. It also limits the distance the water will project without the assistance of wind to only a few feet. This condition is why the rotating tubes carry the water to the outer perimeter of the area to be cooled. Rotating a misting nozzle about an axis on a very short tube is preferable over a stationary nozzle since it mixes with air 360 degrees around the nozzle. Using a long arm to carry the nozzle discharges the mist to far areas with fresh, unsaturated air, distributing the mist a great distance.

The nozzle's thrust as a means to rotate the assembly removes the need for an external source of power. The rotational speed of the device is determined by several significant factors: the pressure of the fluid before leaving the nozzle, the angle at which the nozzle is directed to provide some degree of tangential thrust, the geometry of the misting nozzle, and frictional factors. The flow rate is not a significant factor when the frictional factors are a small percentage. One of the forces governing the device's speed is the acceleration of the water itself. As the flow rate increases, so does the mass of the fluid that is gaining kinetic energy from the device. Increasing the length of the tube improves the mechanical advantage of the nozzle's thrust to help rotation, but the rotational speed will slow down since the water's kinetic energy is limited and the water's velocity at the larger radius can only be maintained if the rotational speed slows down. Adding length to the tubes does reduce the percentage of drag presented by the mechanical friction in the rotary union.

The rotary union of the invention is designed to provide as little friction as possible. A very small diameter rotary seal minimizes the torque it applies. Thrust roller bearings are used to carry the weight of the rotating section to lessen bearing drag. The bearings are placed above the rotary seal and drainage is provided beneath the rotary seal so that in the event of a rotary seal leak, the bearings will not be exposed to contamination. The tubes are as light-weight as possible to avoid significant rotational inertia that could be hazardous.

An improved system to evaporate mist and hence cool the air is provided. It does not require electricity to have the moving air assist in evaporation. The flow rate through the nozzles can be much larger than stationary nozzles since the nozzles are carried over a large distance and will not saturate a single spot. Larger nozzles require less maintenance since they are less susceptible to contamination and calcification. The silently moving tubes blend the mist with the air so more humid environments can also achieve evaporation cooled air.

Figure 2:
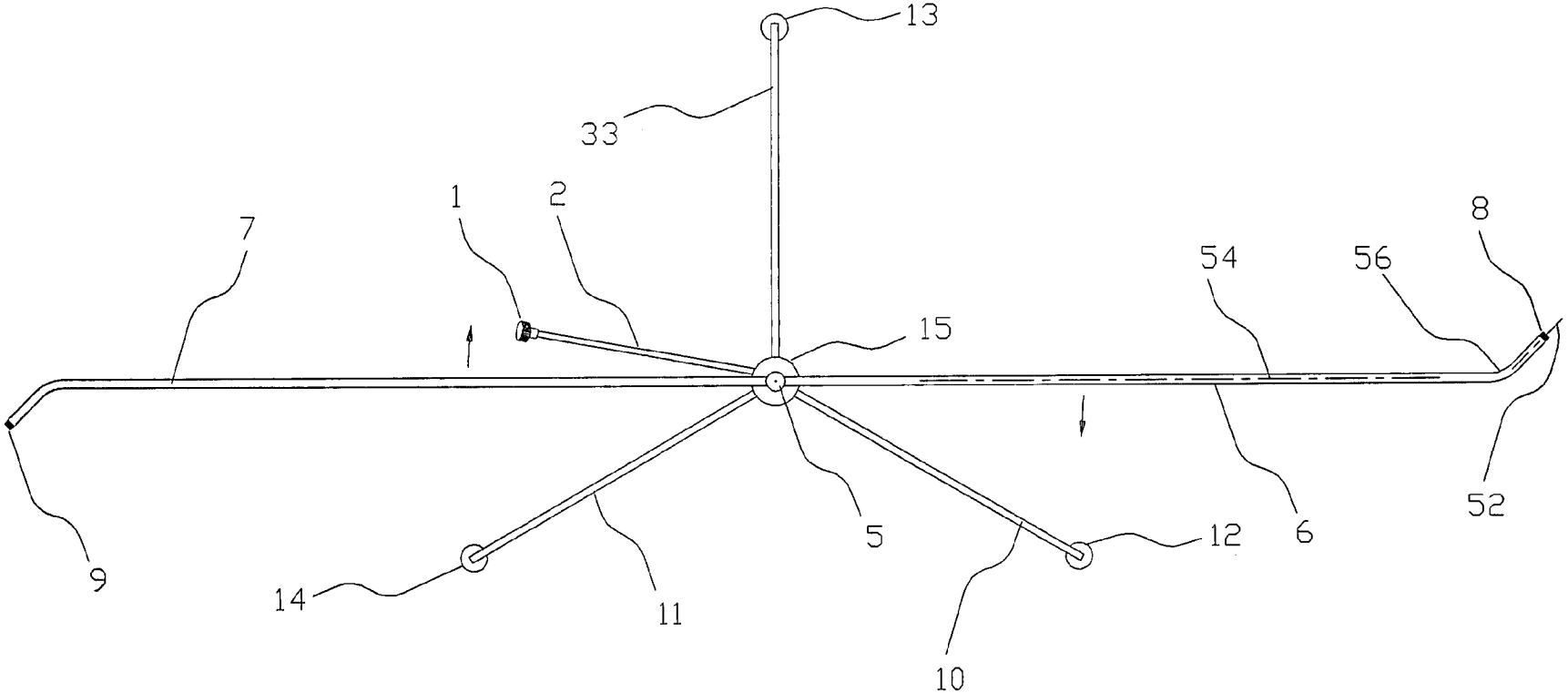
FIG. 2 is a top view of FIG. 1.

With reference now to the detail of the drawings, FIGS. 1 and 2 illustrate a floor stand assembly utilizing the invention. A source of pressurized water is attached to the fluid connector 1. The hose 2 carries the pressurized water through the hollow poles 3 and 4, and passes the water into the rotary assembly 5. The rotary assembly transfers the water from its stationary section connected to pole 4 to its rotating section, which carries radial tubes 6 and 7. Radial tubes 6 and 7 are bent at their outer ends toward tangent vectors on their rotary plane so that misting nozzles 8 and 9 deliver thrust capable of propelling the tubes into rotary motion. Each misting nozzle has a central nozzle axis 52 angled with respect to a horizontal axis 54 of the conduit 6, 7 which does not include the bent portion 56. Since the stationary member 3, 4 is preferably substantially vertical, each bent portion 56 includes a substantially horizontal component to produce the desired thrust. The bent portion may thus reside in a substantially horizontal plane, or may be angled, e.g., at 30°, relative to the horizontal plane. The bent portion 56 is preferably angled at from 20° to 90° in a horizontal plane relative to the axis 54 to produce the desired thrust. The bent portion 56 thus includes a horizontal bend component to produce thrust for rotation, and may also include a vertical bend component to discharge mist upward or downward, as desired. A wedging screw 17 is threadably connected to the base pole 3. The mechanism 17 illustrated in FIG. 4 allows pole 4 to slide within pole 3 and to hold pole 3 at various elevations when the wedging screw 17 is tightened. The base pole 3 is attached to bottom plates 15 and 16. A top view of this design is illustrated in FIG. 2.

FIG. 2 illustrates the axis of rotary assembly 5 and the direction of spin tubes 6 and 7 will take when the device is pressurized. The angle at which nozzles 8 and 9 are bent towards the tangent of the traveled circumference can be varied depending on the desired speed of rotation. The base includes three legs 10,11 and 33 that are fastened to base plates 15 and 16. Adjustable leveling glides 12, 13 and 14 are positioned at the end of the legs to support the structure.

Figure 3:
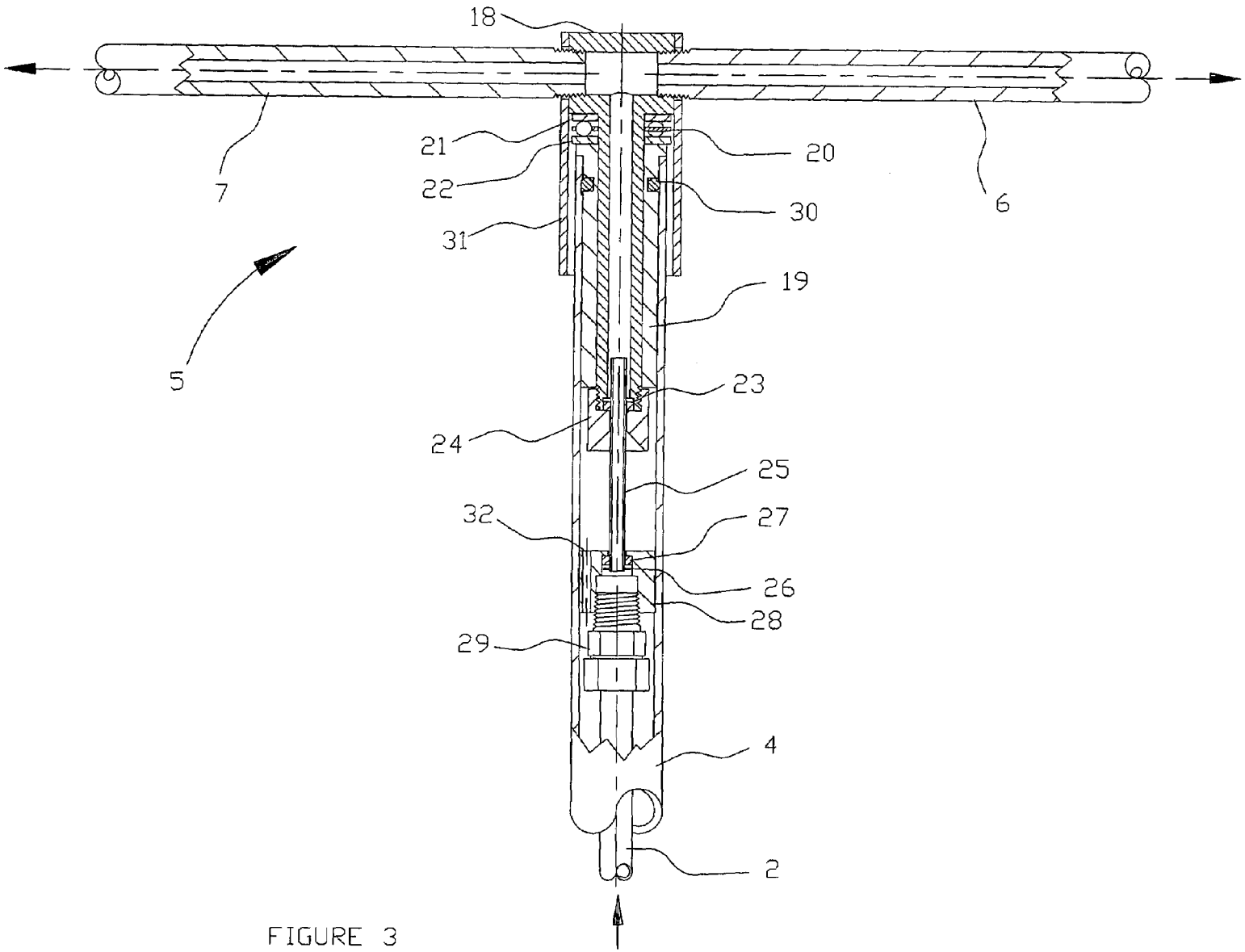
FIG. 3 is a cross-sectional detail of the rotary assembly.

FIG. 3 is a cross sectional detail of the rotary assembly 5. This is one possible rotary connection to provide low friction rotary motion. Hose 2 delivers pressurized water to the rotary assembly's 5 stationary member 28 housed within pole 4 through a fluid connector 29. Stationary member 28 is sealably connected to connector 29 with a pipe thread engagement. Stationary member 28 houses a circular seal ring 27 that provides a sealable connection between tube 25 and stationary member 26. Flange 26 prevents tube 25 from being forced downstream from seal 27. A second circular seal 23 receives the other end of tube 25 and provides a sealable connection between tube 25 and rotary member 18. Cap nut 24 retains seal 23 within rotary member 18. When rotary member spins in relation to stationary member 28, the seals 23 and 27 can be designed so that one or both rotate in relation to tube 25. Bushing 19 holds rotary member 18 on a stable axis. The roller thrust-bearing 20 rides on hardened washers or bearing races 21 and 22 each having a bearing surface perpendicular to the axis of the stationary member 28 to support the one or more conduits and reduce friction between rotary member 18 and bushing 19. Tubes 6 and 7 are sealably connected to rotary member 18 with pipe threads in this case. Flexible ring or snap connection 30 snaps into a groove with pole 4 to allow quick attachment and detachment of the rotary assembly from the stationary components. Cap nut 24 has a bell-mouth for receiving tube 25 when reconnecting the rotating pieces to pole 4. Shield 31 prevents dirt and water from contaminating bearings 20 and bushing 19. A drain passage 32 is provided to allow water that might leak from the sealing rings 23 and 27 to pass away from the bearings 20.

Figure 4:
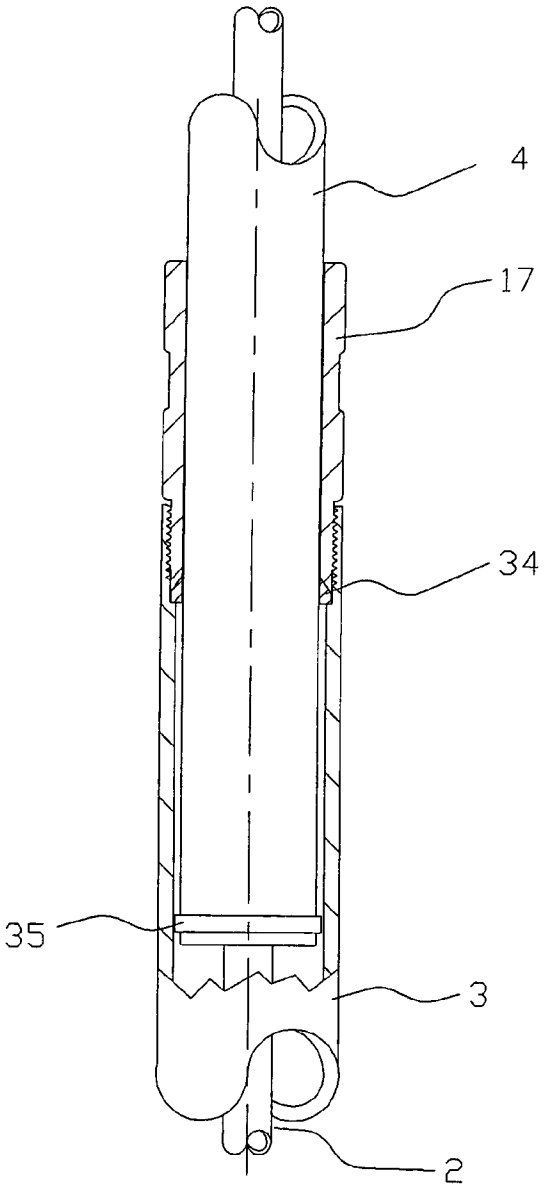
FIG. 4 is a detail of the telescoping assembly.

FIG. 4 illustrates a cross-section of a telescoping mechanism to act between poles 3 and 4. Hollow wedging screw 17 drives the ring wedge 34 into pole 4 when wedging screw 17 is threadably tightened into pole 3. A shoulder within pole 3 prevents ring wedge 34 from axial movement and the mating tapered faces on wedging screw 17 and ring wedge 34 convert the axial force from wedging screw 17 into a radial force pressing ring wedge 34 into pole 3. Bushing 35 holds pole 3 coaxially within pole 4. Many existing methods can be used to secure pole 3 at various positions within pole 4.

Figure 5:
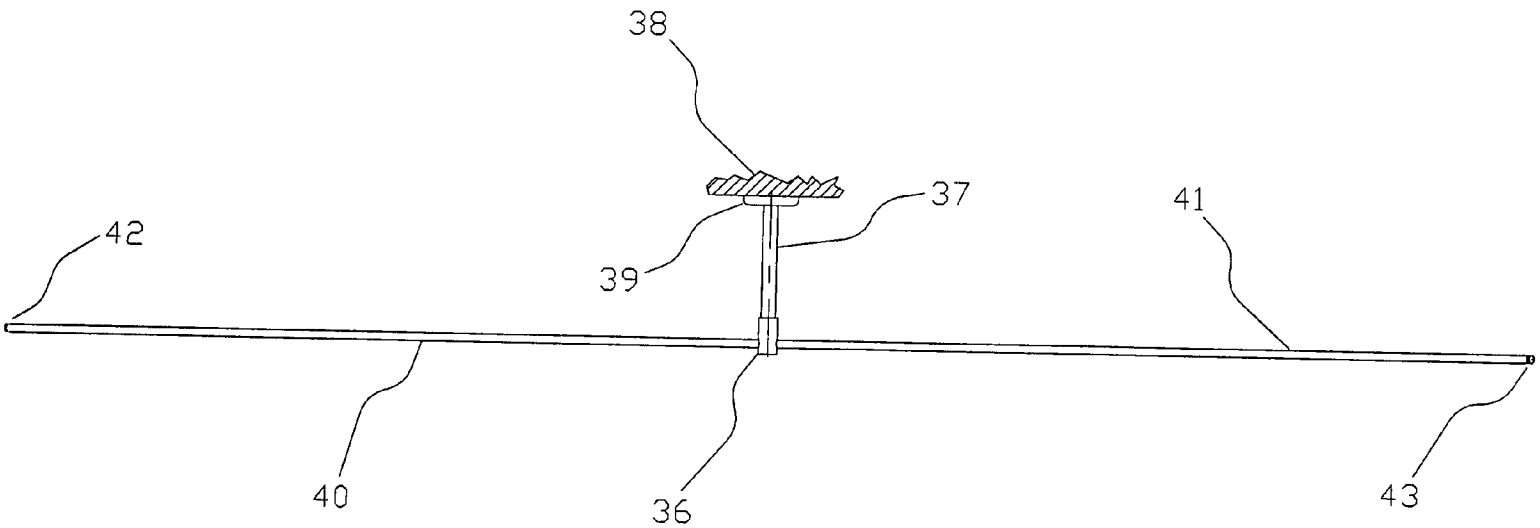
FIG. 5 illustrates the misting unit anchored to a ceiling.

FIG. 5 illustrates an overhead mount design utilizing the invention. Tubes 40 and 41 are sealably connected to rotary assembly 36. The rotary assembly 36 receives pressurized fluid from an external source. Misting nozzles 42 and 43 are secured at the ends of tubes 40 and 41 and are in communication with the pressurized fluid held within tubes 40 and 41. The nozzles 42 and 43 are positioned so that they produce tangential thrust in relation to the circumference they travel. Post 37 suspends the rotary assembly 36 above the area to be cooled. Bracket 39 anchors post 37 to a ceiling or beam 38.

In a preferred embodiment, the rotary swivel assembly 5 is provided at the end of the stationary member, and between the stationary member and the one or more conduits. In another embodiment, the rotary swivel could be provided in the middle or at the end of the stationary member spaced from the one or more conduits, so that both part of the stationary member and the conduits are rotated about the swivel. Also, the embodiment depicted discloses two conduits in fluid communication with the stationary member and extending radially outward from the rotary swivel. In another embodiment, additional conduits could be provided equally spaced circumferentially about the stationary member, or a single conduit could be provided for delivering water to one or more misting nozzles.

According to the method of the invention, the substantially vertical member is provided as disclosed herein having a flow path for transmitting water. A rotary swivel is provided in fluid communication with the vertical member, and one or more conduits are provided each in fluid communication with the vertical member and extending radially outward from the rotary swivel. One or more misting nozzles are each mounted at an outer end of a respective conduit, with each misting nozzle receiving water from a respective conduit and having a central axis angled with respect to a central axis of a respective conduit for discharging mist while producing a tangential thrust for rotating the one or more conduits and the misting nozzles about the vertical member. A stationary member may include a telescoping pole, such that the height of the one or more misting nozzles may be adjusted, or the vertical member may extend downward from an overhead mount.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A water misting and evaporative cooling system, comprising:

an elongate stationary member having a bore therein;

a water hose fitting within the bore of the stationary member for receiving an end of a water hose;

one or more conduits each in fluid communication with the water hose and extending radially outward from the stationary member;

a rotatable sleeve secured to the one or more conduits and in fluid communication with the one or more conduits;

a tube within the bore in the elongate stationary member and having an outer diameter substantially less than an outer diameter of the rotatable sleeve and in fluid communication with the water hose fitting and the rotatable sleeve;

one or more aerating misting nozzles each at an outer end of a respective conduit, each misting nozzle receiving water from a respective conduit and having a central nozzle axis angled with respect to a central axis of a respective conduit for discharging mist while producing a tangential thrust for rotating the one or more conduits and misting nozzles about the stationary member to dispense mist into the air for cooling;

one or more dynamic seals between the tube and the sleeve or between the tube and a member secured to the water hose fitting; and a rotary swivel between the one or more conduits and the elongate stationary member.

2. A water misting system as defined in claim 1, wherein each of the one or more conduits includes a radially outward bent portion for angling a respective nozzle.

3. A water misting system as defined in claim 1, wherein the rotary swivel includes a roller thrust bearing to support the one or more conduits, the thrust bearing including an upper race and a lower race each with a bearing surface perpendicular to an axis of the elongate stationary member.

4. A water misting system as defined in claim 1, wherein the stationary member includes a telescoping pole, such that the height of the one or more misting nozzles may be adjusted.

5. A water misting system as defined in claim 1, further comprising:

a base for supporting the stationary member, the base including at least three legs.

6. A water misting system as defined in claim 1, further comprising:

a snap connection for attaching and detaching the rotary swivel and the one or more conduits from the elongate stationary member.

7. A water misting system as defined in claim 1, wherein the elongate stationary member extends downward from an overhead mount.

8. A water misting and evaporative cooling system, comprising:

an elongate substantially vertical stationary member having a bore therein and comprising first and second axially connecting elongate housings;

a fitting within the second elongate housing for receiving an end of a stationary conduit extending through the first elongate housing and passing at least partially through the second elongate housing:

one or more rotatable conduits each in fluid communication with the stationary conduit, each of the one or more conduits including a radially outward bent portion;

one or more aerating misting nozzles each at an outer end of the bent portion of a respective conduit, each misting nozzle receiving water from a respective conduit and having a central nozzle axis angled with respect to a central axis of a respective conduit for discharging mist while producing a tangential thrust for rotating the one or more conduits and misting nozzles about the elongate member to discharge mist into the air for cooling;

an adjustment member for varying an axial position of the second housing relative to the first housing;

a rotatable sleeve fluidly extending between the filling and the one or more rotatable conduits; and a dynamic seal sealing with the rotatable sleeve.

9. A water misting system as defined in claim 8, further comprising a rotary swivel between the one or more rotatable conduits and the stationary member including a roller thrust bearing with an upper race and a lower race each having a bearing surface perpendicular to the elongate stationary member to support the one or more conduits.

10. A water misting system as defined in claim 9, further comprising:

a snap connection for attaching and detaching the rotary swivel and the one or more conduits from the stationary member.

11. A water misting system as defined in claim 1, wherein the one or more dynamic seals seal between both the tube and the sleeve, and between the tube and the member secured to the fitting.

12. A water misting system as defined in claim 1, wherein the rotatable sleeve includes a shoulder, and the rotary swivel is positioned between the shoulder and the elongate stationary member.

13. A water misting device as defined in claim 1, wherein the rotary swivel is provided above the one or more dynamic seals, such that leakage past the dynamic seals falls by gravity within the stationary elongate member and away from the rotary swivel.

14. A water misting system as defined in claim 9, wherein the rotatable sleeve includes a shoulder, and the rotary swivel is positioned between the shoulder and the elongate stationary member.

15. A water misting device as defined in claim 9, wherein the rotary swivel is provided above the one or more dynamic seals, such that leakage past the dynamic seals falls by gravity within the stationary elongate member and away from the rotary swivel.

16. A water misting and evaporative cooling device, comprising:

a stationary elongate member having a bore therein:

a rotatable sleeve within the bore of the elongate member;

a tube within the bore of the elongate stationary member and having an outer diameter substantially less than an outer diameter of the rotatable sleeve;

a seal sealing with the outer diameter of the tube;

a bushing surrounding the rotatable sleeve and within the bore of the elongate member and guiding rotation of the rotatable sleeve;

one or more rotatable conduits each rotatable with the rotatable sleeve and in fluid communication with the rotatable sleeve and extending radially outward from the rotatable sleeve; one or more aerating misting nozzles each at an outer end of a respective conduit, each misting nozzle receiving water from a respective conduit and having a central nozzle axis angled with respect to a central axis of a respective conduit for discharging mist while producing a tangential thrust for rotating the one or more conduits and misting nozzles.

17. A water misting device as defined in claim 16, wherein the rotatable sleeve includes a shoulder, and a thrust bearing is positioned between the shoulder and the stationary elongate member.

18. A water misting device as defined in claim 17, wherein the thrust bearing includes an upper race and a lower race each with a bearing surface substantially perpendicular to a control axis of the elongate stationary member.

19. A water misting device as defined in claim 16, wherein a rotary swivel is provided above a one or more dynamic seals, such that leakage past the dynamic seals falls by gravity within the stationary elongate member and away from the rotary swivel.

* * * * *